US008292569B2

(12) United States Patent
Sitzler

(10) Patent No.: US 8,292,569 B2
(45) Date of Patent: Oct. 23, 2012

(54) COMPRESSED AIR-MOTOR FOR ROTATIONALLY DRIVEN TOOLS

(75) Inventor: Jan Sitzler, Kraichtal (DE)

(73) Assignee: Schmid & Wezel GmbH & Co., Maulbronn (DE)

( * ) Notice: Subject to any disclaimer, the term of this patent is extended or adjusted under 35 U.S.C. 154(b) by 877 days.

(21) Appl. No.: 12/295,985

(22) PCT Filed: Jan. 17, 2007

(86) PCT No.: PCT/EP2007/000367

§ 371 (c)(1),
(2), (4) Date: Oct. 3, 2008

(87) PCT Pub. No.: WO2007/112795

PCT Pub. Date: Oct. 11, 2007

(65) Prior Publication Data

US 2009/0180859 A1 Jul. 16, 2009

(30) Foreign Application Priority Data

Apr. 5, 2006 (DE) ..... 20 2006 005 899 U

(51) Int. Cl.
*F01D 17/00* (2006.01)

(52) U.S. Cl. ..... 415/25; 415/1; 415/26; 415/36; 415/45; 415/80; 415/156; 415/904

(58) Field of Classification Search ..... 415/1, 13, 415/25, 26, 35, 151, 156, 904, 29, 36, 44–45, 415/80–82; 433/132
See application file for complete search history.

(56) References Cited

U.S. PATENT DOCUMENTS

| | | | | | |
|---|---|---|---|---|---|
| 3,578,872 | A * | 5/1971 | McBurnie | 415/25 |
| 3,707,336 | A * | 12/1972 | Theis et al. | 416/186 R |
| 3,708,240 | A * | 1/1973 | Theis et al. | 415/36 |
| 3,733,143 | A * | 5/1973 | Theis, Jr. | 415/80 |
| 4,060,336 | A * | 11/1977 | Theis et al. | 415/80 |
| 4,087,198 | A * | 5/1978 | Theis, Jr. | 415/82 |
| 4,776,752 | A * | 10/1988 | Davis | 415/25 |
| 5,186,603 | A * | 2/1993 | Kishi | 415/80 |
| 5,261,233 | A * | 11/1993 | Kishi | 60/436 |
| 5,507,642 | A | 4/1996 | Wohlgemuth | 433/132 |
| 5,567,154 | A | 10/1996 | Wohlgemuth | 433/132 |
| 6,241,464 | B1 * | 6/2001 | Huffaker et al. | 415/25 |
| 6,695,573 | B2 * | 2/2004 | Snider | 415/1 |
| 7,223,069 | B2 * | 5/2007 | Dodds | 415/202 |

* cited by examiner

*Primary Examiner* — Fernando L Toledo
*Assistant Examiner* — Victoria K Hall
(74) *Attorney, Agent, or Firm* — O'Shea Getz P.C.

(57) ABSTRACT

An air regulator comprises a housing, a shaft, a first air regulation member and an elastic ring. The shaft is rotationally fixed within the housing. The first air regulation member is coaxially coupled to the shaft and has a plurality of first air flow apertures positioned radially about the shaft. The elastic ring is configured and positioned to centrifugally deform and increasingly block the first air flow apertures.

5 Claims, 4 Drawing Sheets

COMPRESSED AIR-MOTOR FOR ROTATIONALLY DRIVEN TOOLS

PRIORITY INFORMATION

This patent application claims priority from PCT Application No. PCT/EP2007/000367 filed Jan. 17, 2007 and German Application No. 20 2006 005 899.0 filed Apr. 5, 2006, which are hereby incorporated by reference.

BACKGROUND OF THE INVENTION

The invention relates to a compressed-air motor for rotationally driven tools, for example grinders, having a governor for limiting the rotational speed.

Compressed-air motors include turbines, vane motors and gear motors. Compressed-air drives having a governor are disclosed in German Patents DE 43 20 532 C1 and in DE 44 28 039 C1.

There is a need for a motor having a governor that reliably limits rotational speed.

SUMMARY OF THE INVENTION

An air regulator comprises a housing, a shaft, a first air regulation member and an elastic ring. The shaft is rotationally fixed within the housing. The first air regulation member is coaxially coupled to the shaft and has a plurality of first air flow apertures positioned radially about the shaft. The elastic ring is configured and positioned to centrifugally deform and increasingly block the first air flow apertures.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
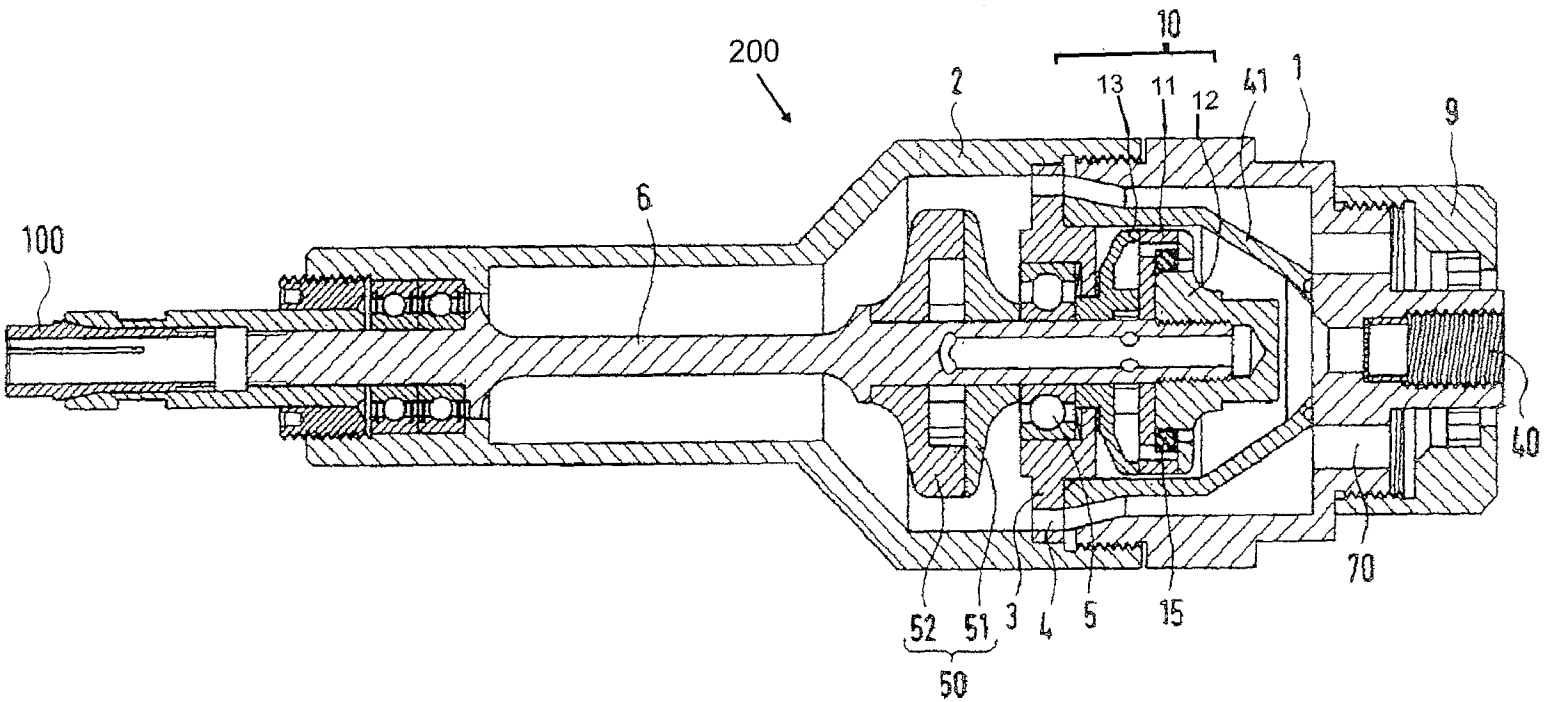
FIG. 1 illustrates a sectional view of one example of a rotary tool.

FIG. 1 illustrates an example of a rotary tool, for example a personal handheld grinder 200, driven by a compressed-air motor. However, the application of compressed-air motors are not limited to grinders, but may be implemented in a variety of other devices, for example a tool spindle or a robot tool.

Figure 3A:
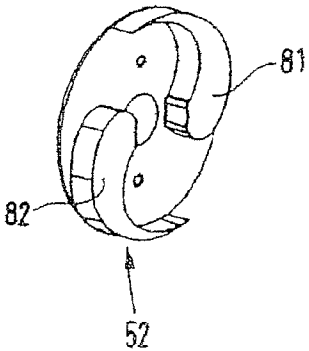
FIGS. 3A to 3B illustrates a perspective view of a first half and a second half of a turbine rotor.
Figure 3B:
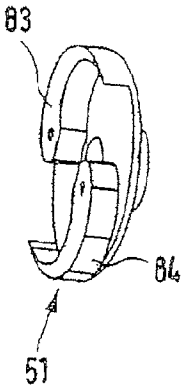
Figure 3C:
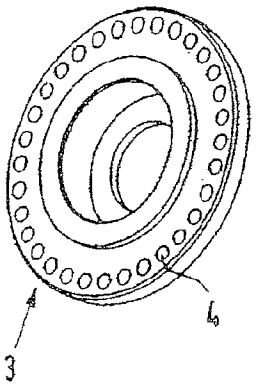
FIG. 3C illustrates a perspective view of a bearing plate.

The grinder 200 comprises a first housing component 1, a second housing component 2 and a cover 9. In one example, the cover 9 is configured to screw onto the first housing 1 and the first housing 1 is configured to screw into the second housing 2. A bearing plate 3, clamped between the first and the second housings 1 and 2, has a plurality of apertures 4 along its circumference, illustrated in FIG. 3C, and is configured to hold a ball bearing 5. A shaft 6 is rotatably supported by the ball bearings 5 in the bearing plate 3 and is configured to support a receptacle element 100. The receptacle element 100 is configured to attached to an accessory, for example a grinding stone.

Figure 3D:
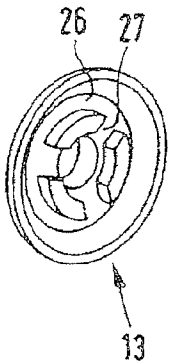
FIG. 3D illustrates a perspective view of an air-guide plate.
Figure 3E:
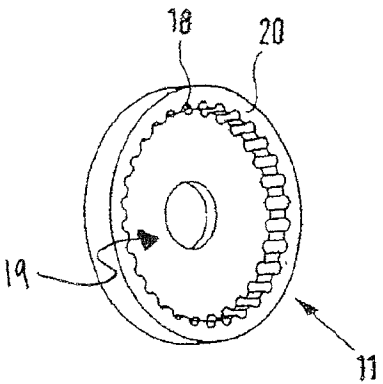
FIGS. 3E-3F illustrates a perspective view of a first and a second plate in a govenor.
Figure 3F:
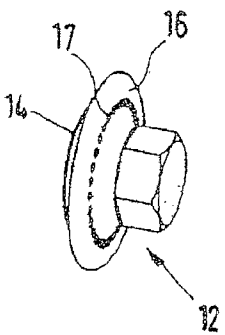
Figure 3G:
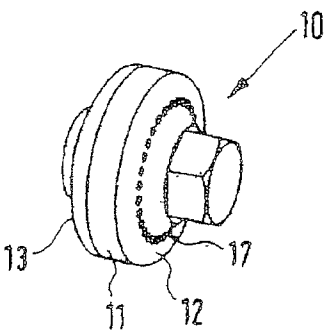
FIG. 3G illustrates a perspective view of the governor.

In one example, a governor 10, shown in FIG. 3G, comprises a first air regulation member, for example a first plate 11, shown in FIG. 3E, a second air regulation member, for example a second plate 12, shown in FIG. 3F, and an air-guiding plate 13, shown in FIG. 3D. The governor 10 is rigidly screwed to the shaft 6 through threads 7. The second plate 12 comprises a hub 14 and a flange 16 having a plurality of apertures 17. A circular elastic ring 15, for example an O-ring, is seated on the hub 14 and defines a control element proper. The apertures 17 are configured and positioned in the plate 12 such that a stream of compressed air entering a space 25 through the apertures 17 is directed onto the ring 15 and deflected radially away from an axial center of the plate 12.

The plate 11 comprises a plurality of apertures 18, shown in FIG. 3E, that are configured and positioned radially about the plate 11. In the present example, the radius on which the apertures 18 lie is greater than the radius on which the apertures 17 lie. In one example, the aperatures 18, fashioned into a pot shape, penetrate completely through the bottom 19 of the plate 11 and partially through a rim 20 of the plate 11. A space 25 is defined by the bottom 9 and the rim 20 of the first plate 11 and the flange 16 of the second plate 12 such that a stream of air entering the space 25 through the apertures 17 may flow past the ring 15 and into the apertures 18. A chamber 26 is defined by the bottom 9 of the first plate 11 and an air-guiding plate 13, shown in FIG. 3D, such that the stream of air may pass through the apertures 18 and into the chamber 26. A plurality of radial channels 27, for example three, are configured and positioned on the air-guiding plate 13 such that the air stream may flow from the chamber 26, through the channels 27 and the apertures 28 and into a bore 30 in the shaft 6.

An air inlet duct 40 positioned in the first housing 1 is coupled to, for example, a conically expanding chamber 35 defined by, for example, a conical partition shell 41 and the governor 10. The partition shell 41 is clamped between the first housing 1 and the bearing plate 3.

Figure 2A:
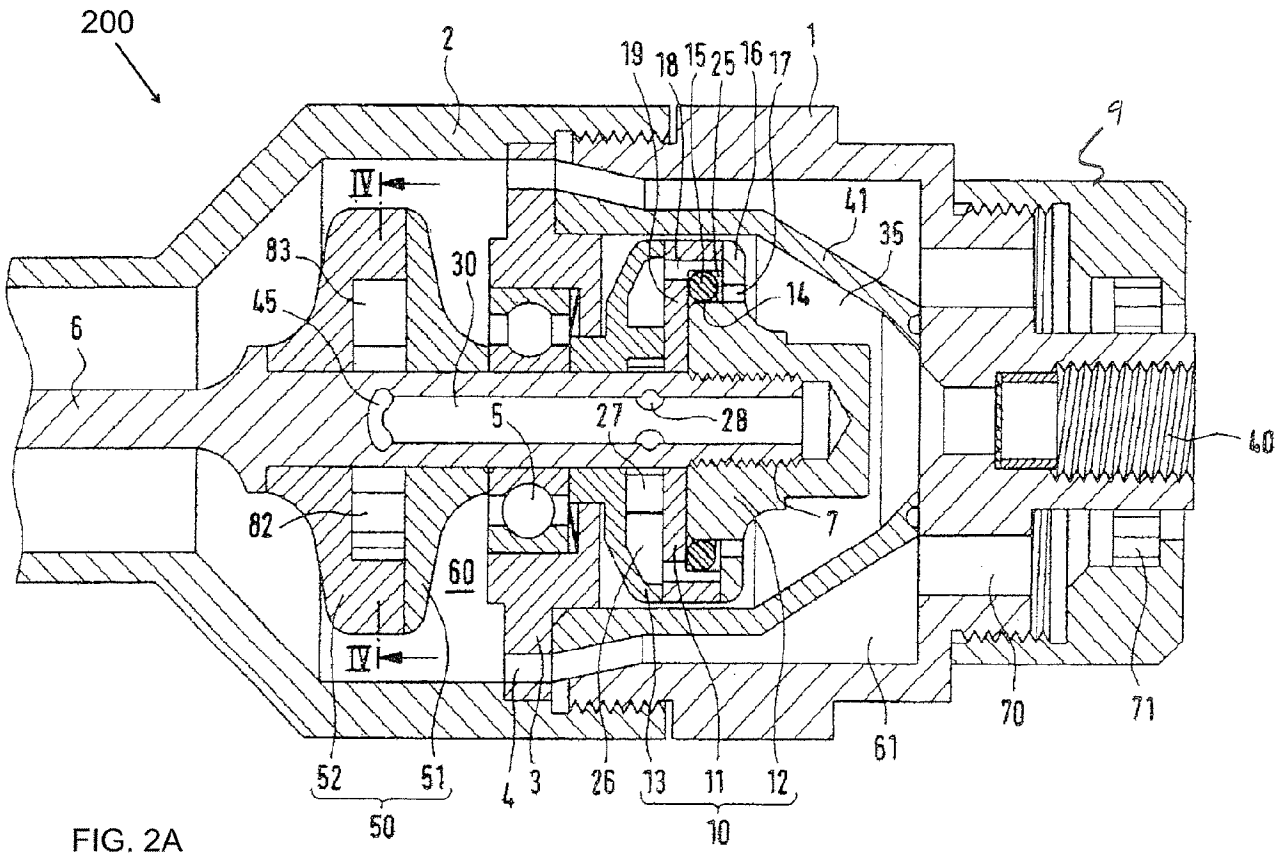
FIG. 2A illustrates an enlarged sectional view of the right-hand portion of the rotary tool in FIG. 1.

An aperture 45 is configured in the bore 30 such that a stream of air may pass from the bore 30 into a plurality of nozzles in a turbine rotor 50. In one example, the turbine rotor 50 comprises a first half 51 and a second half 52. The two halves, shown in FIGS. 3A-3B, each comprise two air-guiding vanes 81, 82 or 83, 84 configured as mirror images. The vanes 81, 82, 83 and 84 are configured to define four nozzles 85, 86, 87 and 88 when the two halves 51 and 52 are joined at a 90° offset and held together by tightening the second plate 12 about the end of the shaft 6, shown in FIG. 2A. The nozzles 85, 86, 87 and 88 lie in a plane perpendicular to the shaft 6 such that the stream of air may exit from the nozzles tangentially to the circular shape of the turbine rotors and thus, through a reaction force, drive the shaft 6 and thereby a tool afixed to the receptacle element 100.

Figure 2B:
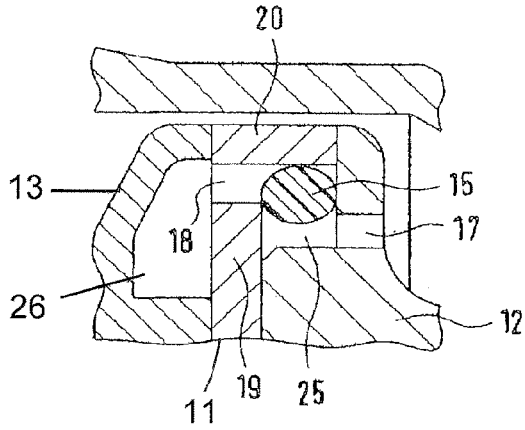
FIG. 2B illustrates a sectional view of an elastic ring in the rotary tool in FIG. 1.
Figure 4:
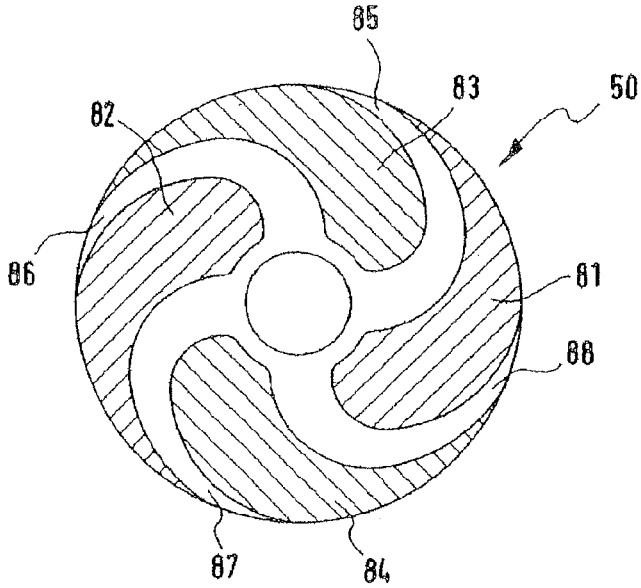
FIG. 4 illustrates a sectional view of a turbine rotor along the arrow IV-IV in FIG. 2A.

When the stream of air flows from the chamber 35 through the apertures 17, the chambers 25, the apertures 18, the chambers 26, the channels 27 and the apertures 28 into the bore 30, control of the rotational speed is effected by the centrifugal force acting on the elastic ring 15 causing the elastic ring to brace against the apertures 18 and the rim 20. The elastic ring 15 may become flattened by the stream of air, thereby taking on an oval shape with the longer axis perpendicular to the shaft 6, shown in FIG. 2B. As the rotational speed increases, the elastic ring 15 blocks an increasingly larger portion of the apertures 18. Therefore, the rotational speed of the compressed air motor is controlled/regulated at a value less than the maximum attainable rotational speed. Correspondingly, when the rotational speed decreases, the elastic ring permits more air into the apertures 18.

A chamber 60, defined by the turbine rotor 50 and the second housing 2, and an annular chamber 61, defined by the partition shell 41 and the first housing 1, are configured such that a return stream of air may flow from the nozzles 85, 86, 87 and 88 in the rotor 50 and the apertures 4 in the bearing plate 3 through at least one exhaust duct 70 in the first housing 1 into at least one passage 71 between the cover 9 and the, for example, nipple-shaped end of the first housing 1.

Reliable and simple rotational-speed limiting/regulation, for example to roughly 45,000 revolutions per minute (rpm), may be achieved in the range of optimal utilization of the energy contained in the air stream. The limiting/regulation depends particularly on the dimensions of the apertures 17, 18, and the size and elasticity of the elastic ring 15. The pressure available at industrial work stations where such implements are used and wherewith such grinders are driven is usually approximately 6-7 bar.

Although the present invention has been illustrated and described with respect to several preferred embodiments thereof, various changes, omissions and additions to the form and detail thereof, may be made therein, without departing from the spirit and scope of the invention.

What is claimed is:

1. An air regulator, comprising:

a housing;

a shaft that rotates within the housing;

a first air regulation member coaxially coupled to the shaft, the first air regulation member having a plurality of first air flow apertures positioned radially about the shaft at a first radial distance;

a second air regulation member coaxially coupled to the shaft, the second air regulation member having a plurality of second air flow apertures positioned radially about the shaft at a second radial distance that is less than the first radial distance;

a chamber defined between the first air regulation member and the second air regulation member;

an elastic ring positioned within the chamber and configured to centrifugally deform and increasingly block the first air flow apertures; and a rotor coupled to the shaft, the rotor having a plurality of vanes, the vanes defining a plurality of nozzles, each nozzle having a first end and a second end, wherein the first air flow apertures are respectively connected to the first ends of the nozzles to permit fluid flow between the first air flow apertures and the nozzles.

2. An air regulator, comprising:

a housing;

a shaft that rotates within the housing;

a first air regulation member coaxially coupled to the shaft, the first air regulation member having a plurality of first air flow apertures positioned radially about the shaft at a first radial distance;

a second air regulation member coaxially coupled to the shaft, the second air regulation member having a plurality of second air flow apertures positioned radially about the shaft at a second radial distance that is less than the first radial distance;

a chamber defined between the first air regulation member and the second air regulation member;

an elastic ring positioned within the chamber and configured to centrifugally deform and increasingly block the first air flow apertures; and a rotor coaxially coupled to the shaft, the rotor having a plurality of vanes, the vanes defining a plurality of nozzles, each nozzle having a first end;

wherein the shaft includes a second chamber, a plurality of third air flow apertures, and a fourth air flow aperture, the third air flow apertures connecting the first air flow apertures to the second chamber to permit fluid flow between the first air flow apertures and the second chamber, and the fourth air flow aperture connecting the second chamber to the first ends of the nozzles to permit fluid flow between the second chamber and the nozzles.

3. The air regulator of claim 1, further comprising a return air flow duct connected to the second ends of the nozzles to permit fluid flow between the return air flow duct and the nozzles.

4. The air regulator of claim 1, wherein the rotor further comprises a first and a second opposed facing rotor members, the first rotor member configured at a ninety degree offset with respect to the second rotor member, the first and the second each having two vanes.

5. A method for regulating air, comprising:

forcing a quantity of air through a plurality of first air flow apertures in a first air regulation member coaxially coupled to a shaft, the first air flow apertures positioned radially about the shaft at a first radial distance;

fluidly guiding the quantity of air, at an air flow rate, through a chamber and into a plurality of second air flow apertures in a second air regulation member coaxially coupled to the shaft, the chamber defined by the first and the second air regulation members, the second air flow apertures positioned radially about the shaft at a second radial distance that is greater than the first radial distance;

centrifugally deforming an elastic ring to regulate the air flow rate by at least one of blocking and unblocking the second air flow apertures; and fluidly guiding the quantity of air through the plurality of second air flow apertures into a rotor.

* * * * *